US009435532B2

(12) United States Patent
Schiessel et al.

(10) Patent No.: US 9,435,532 B2
(45) Date of Patent: Sep. 6, 2016

(54) BURNER OF A GAS TURBINE

(75) Inventors: Pirmin Schiessel, Ehrendingen (CH); Bruno Schuermans, La Tour-de-Peilz (CH); Zdenko Papa, Baden (CH); Norbert Emberger, Neuenhof (CH); Adnan Eroglu, Untersiggenthal (CH); Rainer Conzelmann, Waldshut-Tiengen (DE); Luca Tentorio, Wuerenlingen (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 430 days.

(21) Appl. No.: 12/846,087

(22) Filed: Jul. 29, 2010

(65) Prior Publication Data

US 2011/0027732 A1 Feb. 3, 2011

(30) Foreign Application Priority Data

Jul. 30, 2009 (EP) ..... 09166907

(51) Int. Cl.
*F23L 9/00* (2006.01)
*F23D 11/00* (2006.01)
(Continued)

(52) U.S. Cl.
CPC ..... *F23D 11/38* (2013.01); *F23D 17/002* (2013.01); *F23R 3/286* (2013.01); *F23C 2900/07002* (2013.01); *F23C 2900/07021* (2013.01); *F23R 2900/00014* (2013.01)

(58) Field of Classification Search
CPC ..... F23C 2700/02; F23C 2700/023; F23C 2900/07021; F23D 11/38; F23D 11/12
USPC ..... 431/190, 8, 350; 60/740; 239/403, 239/397.5, 368, 431
See application file for complete search history.

(56) References Cited

U.S. PATENT DOCUMENTS 1,684,647 A * 9/1928 Sonner ..... 431/210
3,266,552 A * 8/1966 Denis ..... 239/430
(Continued)

FOREIGN PATENT DOCUMENTS

DE 4446609 A1 6/1996
DE 19537636 A1 4/1997
(Continued)

OTHER PUBLICATIONS

Trivilos, Epameinondas. Performance and Flow Regimes in Plane 2-D Diffusers with Exit Channels at Low Reynolds Numbers. Diss. Naval Postgraduate School, 2003, Monterey.*
(Continued)

*Primary Examiner* — Avinash Savani
*Assistant Examiner* — Vivek Shirsat
(74) *Attorney, Agent, or Firm* — Buchanan Ingersoll & Rooney PC

(57) ABSTRACT

The burner of a gas turbine includes two or more part cone shells arranged offset with respect to one another and defining a cone shaped chamber with longitudinal tangential slots for feeding air therein. A lance carrying a liquid fuel nozzle arranged centrally in the cone shaped chamber is also provided. A portion of the nozzle facing the cone shaped chamber is divergent in shape. A diffuser angle ($\alpha$) between the wall of the nozzle and a longitudinal axis of the cone shaped chamber is less than 5°. A diverging portion of the nozzle has a diffuser length to nozzle diameter ratio comprised between 2-6. The nozzle diameter is the smaller diameter of the diverging portion.

20 Claims, 4 Drawing Sheets

(51) Int. Cl.

| | |
|---|---|
| ***F02C 7/24*** | (2006.01) |
| ***F23D 11/38*** | (2006.01) |
| ***F23D 17/00*** | (2006.01) |
| ***F23R 3/28*** | (2006.01) |

(56) References Cited

U.S. PATENT DOCUMENTS

| | | | | |
|---|---|---|---|---|
| 4,952,218 | A | 8/1990 | Lipp et al. | |
| 5,431,346 | A * | 7/1995 | Sinaisky | 239/399 |
| 5,664,943 | A | 9/1997 | Joos et al. | |
| 6,270,338 | B1 | 8/2001 | Eroglu et al. | |
| 6,470,672 | B1 * | 10/2002 | Buggele et al. | 60/768 |
| 7,051,956 | B2 * | 5/2006 | Upatnieks | 239/423 |
| 7,137,254 | B1 * | 11/2006 | Dmitrievich et al. | 60/740 |
| 2003/0150217 | A1 * | 8/2003 | Gutmark et al. | 60/776 |
| 2005/0028532 | A1 | 2/2005 | Bernero et al. | |
| 2008/0163626 | A1 | 7/2008 | Bernero et al. | |

FOREIGN PATENT DOCUMENTS

| | | | |
|---|---|---|---|
| EP | 0362997 | A1 | 4/1990 |
| EP | 0692675 | A2 | 1/1996 |
| EP | 0911583 | A1 | 4/1999 |
| WO | 95/03129 | A1 | 2/1995 |
| WO | WO 03/054447 | A1 | 7/2003 |
| WO | WO 2008/052360 | A1 | 5/2008 |

OTHER PUBLICATIONS

European Search Report dated Dec. 15, 2009, for European Application No. 09166907.7.

Extended European Search Report issued Nov. 19, 2014 by the European Patent Office in corresponding European Patent Application No. 10167953.8.

* cited by examiner

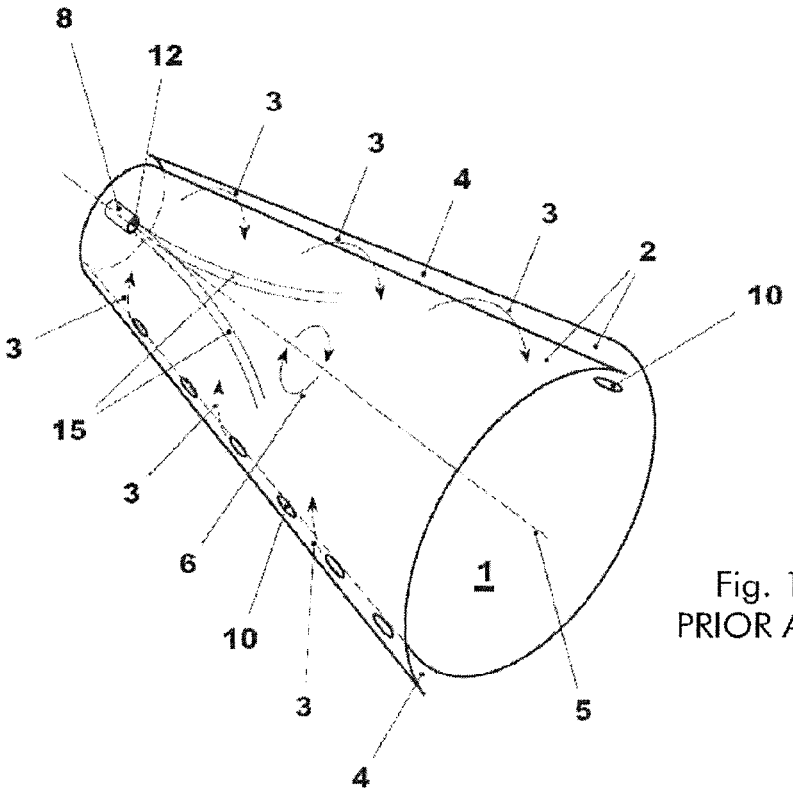
Fig. 1
PRIOR ART
Fig. 2
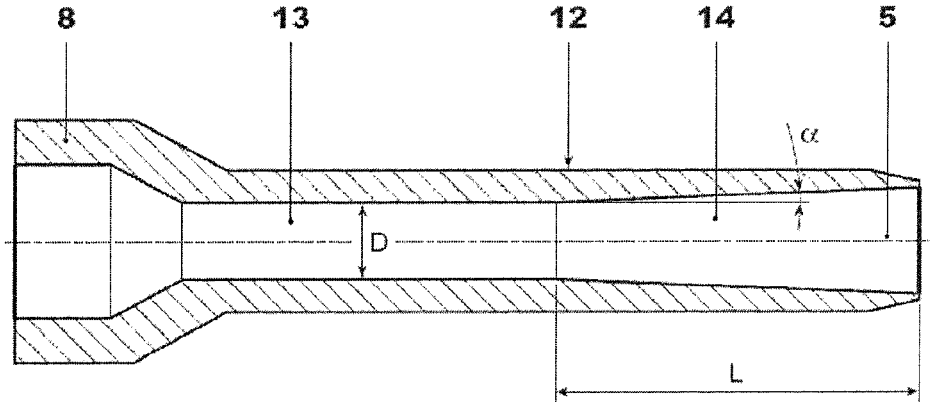

BURNER OF A GAS TURBINE

RELATED APPLICATION

This application claims priority under 35 U.S.C. §119 to European Patent Application No. 09166907.7 filed in Europe on Jul. 30, 2009, the entire content of which is hereby incorporated by reference in its entirety.

FIELD

The present disclosure relates to a burner of a gas turbine.

BACKGROUND INFORMATION

FIG. 1 shows a known burner. This burner has a cone shaped chamber 1 defined by two part cone shells 2 wherein air 3 can be introduced through slots 4.

The air generates in the centre of the cone shaped chamber 1 (i.e. along the axis 5 of the cone shaped chamber 1) a zone of larger vortices 6 (the vortex core).

A lance 8 is provided along the axis 5 to inject a thin liquid fuel jet 15 into the cone shaped chamber 1. In particular the liquid fuel jet 15 can be injected into the vortex core 6 to mix with the air and form a combustible mixture.

Nevertheless, when the liquid fuel jet cross-section is too small, it withstands large asymmetrical centrifugal forces because the liquid fuel jet can not reliably stay within the equally small vortex core and misses the centre, with large gradients of circumferential velocity, which then can prevent it from staying at the vortex core. In practice, during operation the liquid fuel jet 15 fluctuates radially around the vortex core.

These fluctuations can lead to combustion instabilities that are amplified in the burner and combustion chamber downstream of the burner.

U.S. Pat. No. 6,270,338 describes a burner of a gas turbine having these features.

Combustion instabilities can influence both the lifetime and noise emissions. In particular, low frequency instabilities with a frequency less than 30 Hz can be difficult to deal with.

In fact, it can be difficult to suppress these instabilities with operation changes, and damping of these low frequency's instabilities using, for example, Helmholtz dampers can be difficult, because of the huge resonator volumes that would be required.

These problems can also be increased by the fact that low frequency pulsations couple the exhaust system, amplify the noise and propagate it into the neighbouring areas of the power plant.

Burners having a lance with a divergent outlet are also known.

In this respect, WO 03/054447 discloses a lance having a tip with a diverging portion and a diverter facing it. The diffuser angle is very large and also thanks to the diverter, the fuel jet can be diverted laterally generating a conical fuel flow.

U.S. Patent Application No. 2003/150217 discloses a lance with a large conical tip arranged to fan out the fuel after injection.

DE 19537636 discloses a lance with a very short diverging portion with a wide diverging angle. This diverging portion can be arranged to generate a conical fuel flow.

EP 692675 and DE 4446609 disclose a lance having a cylindrical end that feeds the fuel in a conical atomisation chamber wherein atomisation air is injected. The mixture formed in the atomisation chamber can then be fed to a conical burner chamber. In these burners the lance does not inject a liquid jet (in the form of a liquid cylinder) into the vortex core.

SUMMARY

A burner of a gas turbine is disclosed including at least two part cone shells arranged offset with respect to one another and defining a cone shaped chamber with longitudinal tangential slots for feeding air therein, and a lance carrying at least a liquid fuel nozzle arranged centrally in the cone shaped chamber. A portion of the nozzle facing the cone shaped chamber is divergent in shape. A diffuser angle ($\alpha$) between a wall of the nozzle and a longitudinal axis of the cone shaped chamber is less than 5°, and the diverging portion of the nozzle has a diffuser length to nozzle diameter ratio between 2-6, and the nozzle diameter is a smaller diameter of the diverging portion.

BRIEF DESCRIPTION OF THE DRAWINGS

Further characteristics and advantages of the disclosure will be more apparent from the description of an exemplary but non-exclusive embodiments of the burner according to the disclosure, illustrated by way of non-limiting example in the accompanying drawings, in which:

FIG. 1 is a schematic view of a known burner with a cone shaped chamber;

FIG. 2 shows an exemplary embodiment of a nozzle of the lance according to the disclosure;

DETAILED DESCRIPTION

Figure 3:
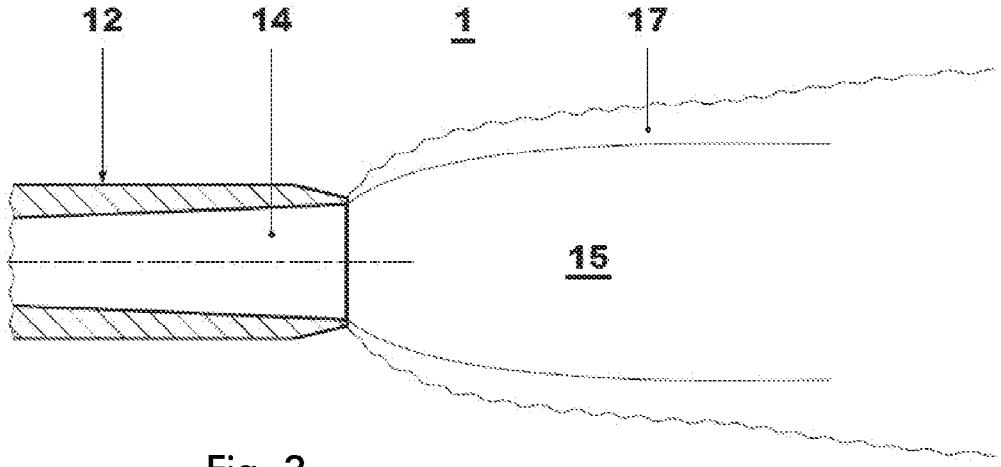
FIG. 3 shows a detail of the nozzle of FIG. 2 and a liquid fuel jet injected through it.
Figure 4:
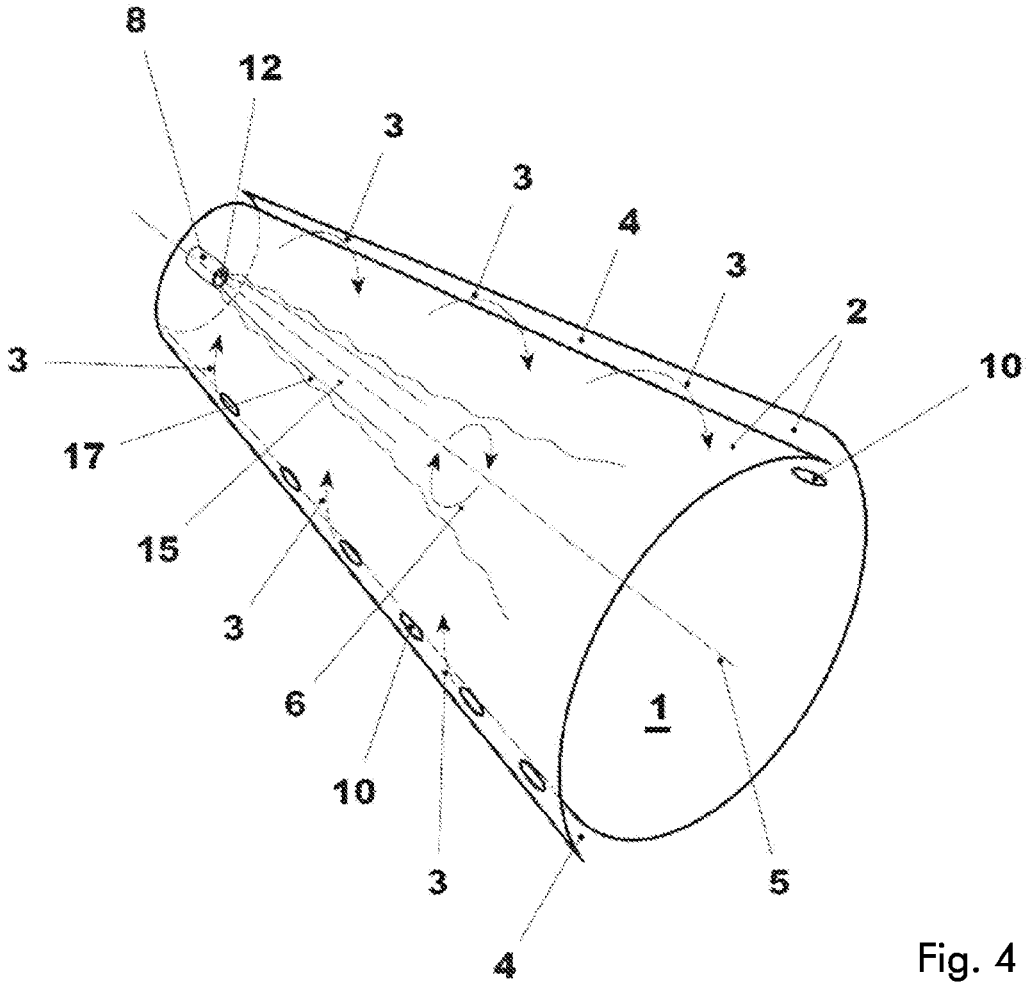
FIG. 4 is a schematic view of a burner with a cone shaped chamber according to an exemplary embodiment of the disclosure.

An aspect of the disclosure provides a burner with which combustion instabilities are limited and thus noise, in particular low frequency noise, can be reduced.

A further aspect of the disclosure provides a burner in which a liquid fuel jet can be injected into the vortex core.

Another aspect of the disclosure provides a burner that can have a longer lifetime with respect to traditional burners.

The burner in exemplary embodiments of the disclosure has a lance with a small angle with defined proportions that can allow a liquid jet to be generated that has a cross-section larger than the cross-section of the passage defined by the lance, but does not open forming a fuel cone. This allows a lance having small-cross-section to be manufactured, increasing ease of assembly and reducing lance complexity.

The disclosure relates to a burner of a gas turbine. The structure of the burner has two part cone shells 2 arranged offset with respect to one another and defining a cone shaped chamber 1. The cone shaped chamber 1 has two longitudinal tangential slots 4 for feeding air 3, and a lance 8 arranged along the axis 5 for feeding a liquid fuel. The lance 8 faces the cone shaped chamber 1 directly, i.e. without any component in between and can be arranged to inject a liquid jet (i.e. in the form of a liquid cylinder).

Different embodiments of the disclosure are possible and, in this respect, the burner may also have more than two part cone shells.

The cone shells can also be provided with nozzles 10 arranged on each of the cone shell, close to the tangential slots 4, to inject gaseous fuel into the cone shaped chamber 1.

In addition, the cone shells 2 can be housed in a plenum (not shown) wherein compressed air coming from the compressor of the gas turbine (not shown) can be fed. This air enters through the tangential slots 4 into the cone shaped chamber 1. Downstream of the cone shaped chamber 1 a combustion chamber (not shown) can be provided.

The lance 8 carries a liquid fuel nozzle 12 arranged centrally in the cone shaped chamber 1, i.e. a longitudinal axis of the nozzle 12 overlaps the axis 5.

The axis of the lance 8 can be the same as the axis of the nozzle 12 and it can also be the same as the axis 5 of the cone shaped chamber 1.

The nozzle 12 has a first portion 13 with a constant diameter D and, downstream of it, a second portion 14, facing the cone shaped chamber 1, that is divergent in shape.

The diverging portion 14 of the nozzle 12 has a diffuser angle $\alpha$ (i.e. an angle between the wall of the nozzle and the axis 5) of less than 5° and greater than 0°. The diffuser angle $\alpha$ can be between 1.5-2.2° and in other exemplary embodiments the diffuser angle $\alpha$ can be between 2-4°.

In addition, the diverging portion 14 of the nozzle 12 can have a diffuser length L to nozzle diameter D ratio between 2-6, between 3-5 or about 4. The diffuser length L is the length of the diverging portion 14 of the nozzle 12 and the nozzle diameter D is the smaller diameter of the diverging portion 14 (i.e. the diameter D of the first portion 13 of the nozzle 12).

The operation of the burner of the disclosure is now described below.

The burner can operate with gaseous fuel and liquid fuel.

During operation with gaseous fuel, air can be injected through the tangential slots 4 and gaseous fuel through the nozzles 10. This operation occurs in a known way.

During operation with liquid fuel, air can be introduced into the cone shaped chamber 1 through the slots 4 and liquid fuel can be injected through the nozzle 12 at the tip of the lance 8.

Because of the diverging portion 14, when the liquid fuel goes out from the nozzle 12 it can form a liquid jet 15 having a thickness (i.e. a diameter) larger than the smaller diameter of the diverging portion 14 and also larger than the greater diameter of the diverging portion 14 (i.e. the diameter of the terminal portion of the diverging portion 14) but it does not open forming a conical surface. For example, the liquid fuel forms a liquid jet that is substantially cylindrical with a cross-section larger than the largest inner cross-section of the nozzle.

Since the diameter of the liquid jet 15 can be large (in particular larger than in traditional burners), when the liquid fuel jet 15 enters the vortex core 6, it can be subjected to substantially symmetrical centrifugal forces that do not urge it outside of the vortex core 6.

Consequently the liquid jet 15 can stay within the vortex core 6 without radial fluctuations, limiting in particular low frequency combustion instabilities and low frequency noise.

In addition, thanks to the diverging portion 14, immediately outside of the nozzle 12 a number of liquid fuel drops can start to separate from the liquid fuel jet 15, generating a large zone 17 made of liquid fuel drops and vapour fuel (the vapour being the liquid already evaporated). This zone can improve mixing of the fuel with air and limits combustion instabilities (and in particular low frequency instabilities) and noise (in particular low frequency noise).

Advantageously, thanks to the mixing improvement of the liquid fuel and air, the burner of the disclosure also has sensibly reduced $NO_x$ emissions and smoke emissions.

Moreover, the improved combustion stability can allow an extended lifetime to be achieved.

Test

Tests were performed to ascertain the operation of a combustion chamber having a lance in embodiments of the disclosure.

In particular the lance used during the tests has these features:

L/D=4

D=3.2 millimeters $\alpha$=2

The results of those tests are shown in FIGS. 5 through 9.

Figure 5:
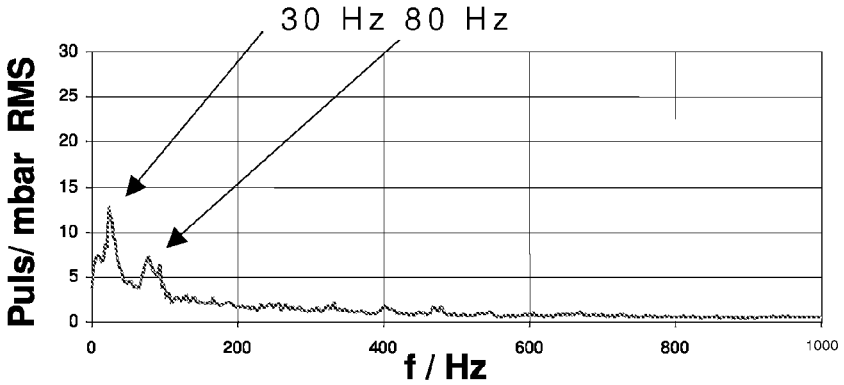
FIGS. 5 and 6 are respectively a diagram showing the pulsations in a known combustion chamber and in a combustion chamber having the lance in exemplary embodiments of the disclosure.

FIG. 5 shows the operation of a gas turbine with a combustion chamber having a traditional lance. FIG. 5 shows that large pulsations can be generated at 30 Hz. These pulsations can be detrimental for the gas turbine operation because they couple the exhaust system and generate large noise.

Figure 6:
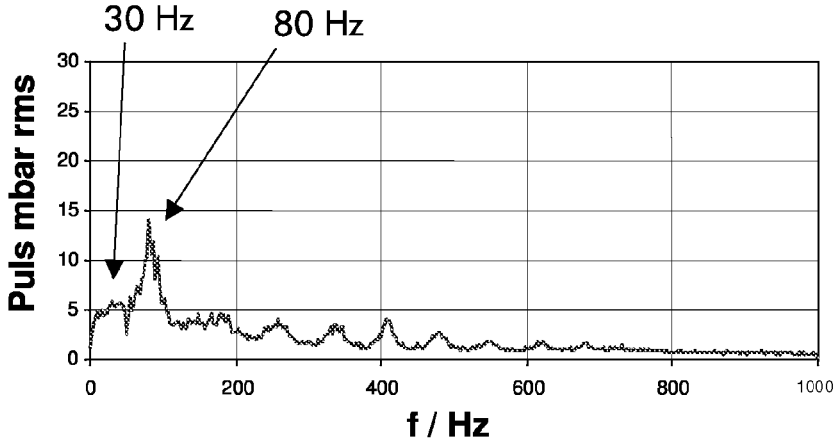

FIG. 6 shows the operation of a gas turbine with a combustion chamber having the lance above described. It is evident that in this case pulsations at 30 Hz are severely damped. In contrast pulsations at about 80 Hz are increased, but these pulsations are not detrimental for the gas turbine operation, because they are naturally damped by the exhaust system. In other words, the pulsation peak can be shifted from a troubling frequency (i.e. about 30 Hz) to a not troubling frequency (i.e. about 80 Hz).

Figure 7:
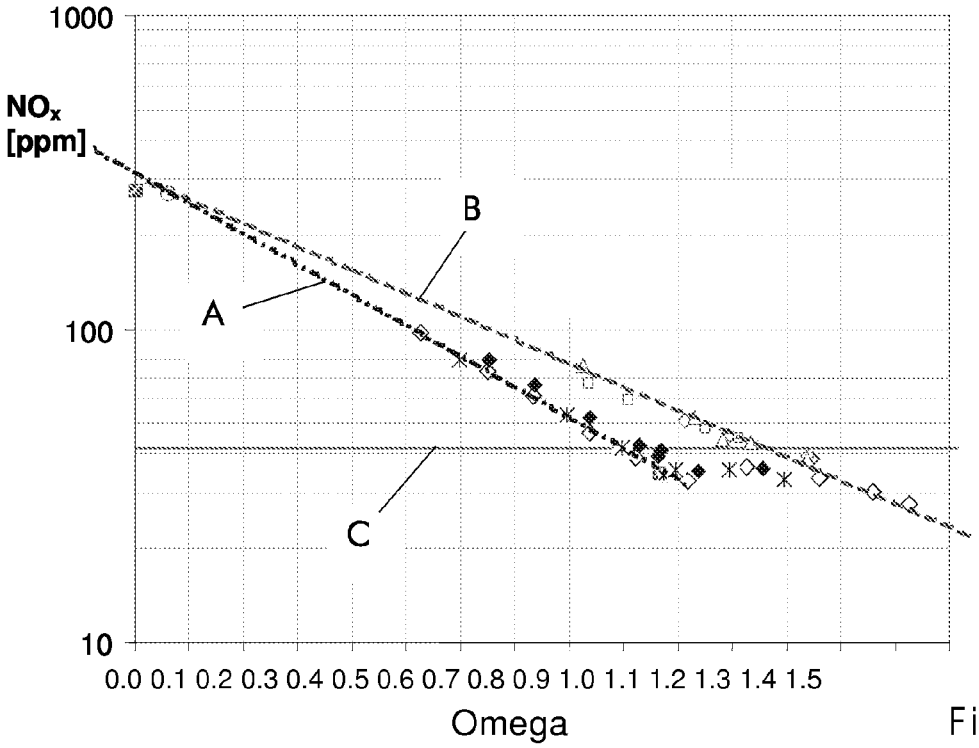
FIG. 7 shows a diagram indicative of the water flow injected into the combustion chamber and the $NO_x$ generated respectively with a known combustion chamber and a combustion chamber having a lance in accordance with exemplary embodiments of the disclosure.

FIG. 7 shows that with a combustion chamber having a lance in exemplary embodiments of the disclosure the amount of water to be injected into the combustion chamber during gas turbine operation (curve A) can be much lower than the amount of water to be injected with gas turbine having a traditional lance (curve B) for given $NO_x$ emissions. This can allow a cheaper operation, in particular in zones where water is expensive, or allows a $NO_x$ emission reduction (in this drawing line C indicates the $NO_x$ limit allowed). In FIG. 7 the $NO_x$ emissions are plotted on the ordinate and on the abscissa Omega identifies the ratio between injected water and liquid fuel mass flow (oil mass flow).

Figure 8:
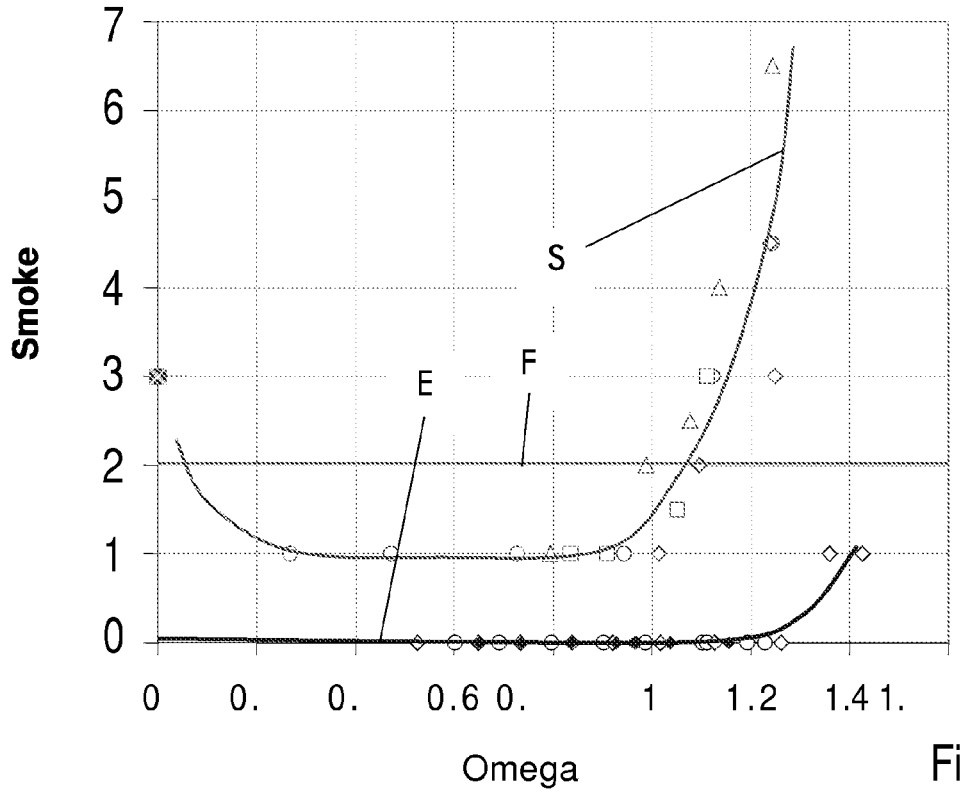
FIG. 8 shows a diagram indicative of the smoke generated respectively with a known combustion chamber and a combustion chamber having a lance in accordance with exemplary embodiments of the disclosure.

FIG. 8 shows that the gas turbine with the lance in exemplary embodiments of the disclosure also can have reduced smoke emissions and/or reduced water consumption. In particular curve S indicates the smoke generated by gas turbines having a traditional lance, whereas curve E indicates the smoke generated by gas turbines having a lance in exemplary embodiments of the disclosure. In FIG. 8 line F indicates the smoke limit allowed. Values 0 through 7 on the ordinate can be indicative of the amount of smoke generated. Level 0 corresponds to no visible smoke and levels 1 through 7 correspond to increasing smoke. On the abscissa Omega identifies the ratio between injected water and liquid fuel mass flow (oil mass flow).

Figure 9:
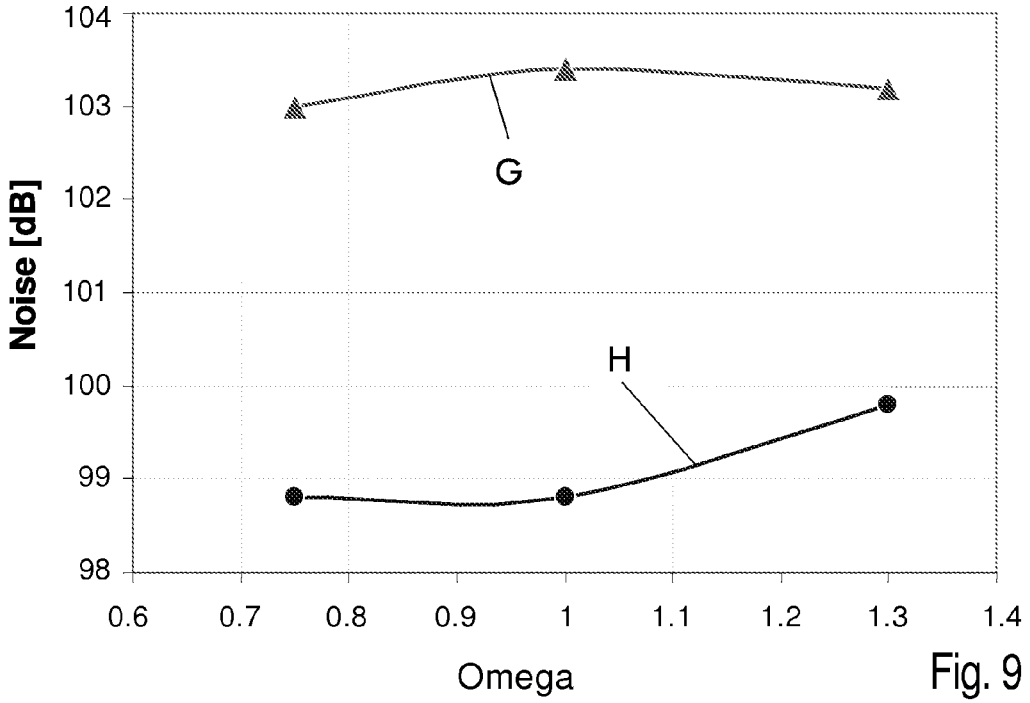
FIG. 9 shows a diagram indicative of the noise generated respectively with a known combustion chamber and a combustion chamber having a lance in accordance with exemplary embodiments of the disclosure.

FIG. 9 indicates the noise generated by a gas turbine with a known lance (curve G) and a gas turbine having a combustion chamber with a lance in exemplary embodiments of the disclosure (curve H). On the ordinate there is indicated the noise (in decibels) and on the abscissa, Omega identifies the ratio between injected water and liquid fuel mass flow (oil mass flow). From FIG. 9 it appears that the noise generated in a gas turbine with the lance in the exemplary embodiments of the disclosure can be much lower than in known gas turbines having known lances (on the ordinate there is a logarithmic scale) or that for a given noise level the amount of water injected may be reduced.

Naturally the features described may be independently provided from one another.

In practice the materials used and the dimensions can be chosen according to requirements.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1 cone shaped chamber
2 part cone shell
3 air
4 tangential slot
5 longitudinal axis of the cone shaped chamber
6 vortex core
8 lance
10 gaseous fuel nozzle
12 liquid fuel nozzle
13 first portion of the nozzle 12
14 diverging portion of the nozzle 12
15 liquid jet
17 zone encircling the jet 15 made of liquid fuel drops and vapor fuel
α diffuser angle
D nozzle diameter
L diffuser length
A $NO_x$/Omega relationship with burners having traditional lances
B $NO_x$/Omega relationship with burners having lances in embodiments of the disclosure
C $NO_x$ limit allowed
S smoke/Omega relationship with burners having traditional lances
E smoke/Omega relationship with burners having lances in embodiments of the disclosure
F smoke limit allowed
G noise/Omega relationship with burners having traditional lances
H noise/Omega relationship with burners having lances in embodiments of the disclosure

What is claimed is:

1. Burner of a gas turbine, comprising:

at least two part cone shells arranged offset with respect to one another and defining a cone shaped chamber with longitudinal tangential slots for feeding air therein;

a lance carrying a liquid fuel nozzle arranged centrally in the cone shaped chamber and configured to inject only a liquid fuel jet, the liquid fuel nozzle having a circular cross section, and wherein a portion of the internal flow path of the nozzle facing the cone shaped chamber is divergent in shape, wherein an internal diffuser angle (α) between a wall of the nozzle and a longitudinal axis of the cone shaped chamber is less than 5° and is constant along the length of the divergent portion of the nozzle, and the diverging portion of the nozzle has a diffuser length to internal nozzle diameter ratio between 2-6, and the internal nozzle diameter is a smaller diameter of the diverging portion, and wherein the cone shaped chamber has a cross section which is greater than a cross section of an exit of the liquid fuel nozzle at a location of fuel injection into the chamber, and wherein the lance terminates at an exit plane of the diverging portion of the nozzle, the liquid fuel nozzle having a first portion with a constant internal diameter, and extending in a direction of the longitudinal axis of the cone shaped chamber to a second portion downstream of the first portion, the second portion facing the cone shaped chamber and is divergent in shape, and wherein the internal diameter of the first portion is equal to an internal diameter of the second portion at an inlet of the second portion; and wherein the liquid fuel nozzle is arranged in the cone shaped chamber such that immediately outside of the nozzle, droplets can start to separate from a generated liquid fuel jet, and the generated liquid jet is substantially cylindrical with a cross section larger than a largest inner cross section of the nozzle.

2. Burner as claimed in claim 1, wherein the diffuser angle (α) is greater than 1.5°.

3. Burner as claimed in claim 1, wherein the diverging portion of the nozzle has a diffuser angle (α) between 1.5-2.2°.

4. Burner as claimed in claim 1, wherein the diverging portion of the nozzle has a diffuser angle (α) between 2-4°.

5. Burner as claimed in claim 1, wherein the diverging portion of the nozzle has a diffuser length to nozzle diameter ratio between 3-5.

6. Burner as claimed in claim 1, wherein the diverging portion of the nozzle has a diffuser length to nozzle diameter ratio of 4.

7. Burner of a gas turbine, comprising:

at least two part cone shells arranged offset with respect to one another and defining a cone shaped chamber with longitudinal tangential slots for feeding air therein;

a cylindrical lance carrying a liquid fuel nozzle arranged centrally in the cone shaped chamber and configured to inject only a liquid fuel jet, the liquid fuel nozzle having a circular cross section, and wherein a portion of the internal flow path of the nozzle facing the cone shaped chamber is divergent in shape, wherein an internal diffuser angle (α) between a wall of the nozzle and a longitudinal axis of the cone shaped chamber is less than 5° and is constant along the length of the divergent portion of the nozzle, and the diverging portion of the nozzle has a diffuser length to internal nozzle diameter ratio between 2-6, and the internal nozzle diameter is a smaller diameter of the diverging portion, and wherein the lance terminates at an exit plane of the diverging portion of the nozzle, the liquid fuel nozzle having a first portion with a constant internal diameter, and extending in a direction of the longitudinal axis of the cone shaped chamber to a second portion downstream of the first portion, the second portion facing the cone shaped chamber and is divergent in shape, and wherein the internal diameter of the first portion is equal to an internal diameter of the second portion at an inlet of the second portion; and wherein the liquid fuel nozzle is arranged in the cone shaped chamber such that immediately outside of the nozzle, droplets can start to separate from the liquid fuel jet, and the generated liquid jet is substantially cylindrical with a cross section larger than a largest inner cross section of the nozzle.

8. Burner as claimed in claim 7, wherein the cone shaped chamber has a cross section which is greater than a cross section of an exit of the liquid fuel nozzle at a location of fuel injection into the chamber.

9. Burner as claimed in claim 7, wherein the diffuser angle ($\alpha$) is greater than 1.5°.

10. Burner as claimed in claim 7, wherein the diverging portion of the nozzle has a diffuser angle ($\alpha$) between 1.5-2.2°.

11. Burner as claimed in claim 7, wherein the diverging portion of the nozzle has a diffuser angle ($\alpha$) between 2-4°.

12. Burner as claimed in claim 7, wherein the diverging portion of the nozzle has a diffuser length to nozzle diameter ratio between 3-5.

13. Burner as claimed in claim 7, wherein the diverging portion of the nozzle has a diffuser length to nozzle diameter ratio of 4.

14. Burner as claimed in claim 1, wherein the liquid fuel nozzle has a continuous inner surface.

15. Burner as claimed in claim 7, wherein the liquid fuel nozzle has a continuous inner surface.

16. A method for injecting of a liquid fuel jet that is substantially cylindrical, the method comprising:

arranging at least two part cone shells offset with respect to one another and defining a cone shaped chamber with longitudinal tangential slots for feeding air therein;

arranging a lance carrying a liquid fuel nozzle centrally in the cone shaped chamber and configured to inject only a liquid fuel jet, the liquid fuel nozzle having a circular cross section, and wherein a portion of the internal flow path of the nozzle facing the cone shaped chamber is divergent in shape, wherein an internal diffuser angle ($\alpha$) between a wall of the nozzle and a longitudinal axis of the cone shaped chamber is less than 5° and is constant along the length of the divergent portion of the nozzle, and the diverging portion of the nozzle has a diffuser length to internal nozzle diameter ratio between 2-6, and the internal nozzle diameter is a smaller diameter of the diverging portion, and wherein the cone shaped chamber has a cross section which is greater than a cross section of an exit of the liquid fuel nozzle at a location of fuel injection into the chamber, and wherein the lance terminates at an exit plane of the diverging portion of the nozzle, the liquid fuel nozzle having a first portion with a constant internal diameter, and extending in a direction of the longitudinal axis of the cone shaped chamber to a second portion downstream of the first portion, the second portion facing the cone shaped chamber and is divergent in shape, and wherein the internal diameter of the first portion is equal to an internal diameter of the second portion at an inlet of the second portion; and arranging the liquid fuel nozzle in the cone shaped chamber such that immediately outside of the nozzle, droplets can start to separate from a generated liquid fuel jet; and the generated liquid jet is substantially cylindrical with a cross section larger than a largest inner cross section of the nozzle.

17. The method as claimed in claim 16, wherein the diffuser angle ($\alpha$) is greater than 1.5°.

18. The method as claimed in claim 16, wherein the diverging portion of the nozzle has a diffuser angle ($\alpha$) between 1.5-2.2°.

19. The method as claimed in claim 16, wherein the diverging portion of the nozzle has a diffuser angle ($\alpha$) between 2-4°.

20. The method as claimed in claim 16, wherein the diverging portion of the nozzle has a diffuser length to nozzle diameter ratio between 3-5.

* * * * *